US007182320B2

(12) United States Patent
Heimbecker et al.

(10) Patent No.: US 7,182,320 B2
(45) Date of Patent: Feb. 27, 2007

(54) INTEGRATED CABLE GUARDRAIL SYSTEM

(75) Inventors: Chad Garrett Heimbecker, Allentown, PA (US); William Bryson, Easton, PA (US); William Atwood, Kosciusko, MS (US)

(73) Assignee: Bryson Products, Inc., Bethlehem, PA (US)

( * ) Notice: Subject to any disclaimer, the term of this patent is extended or adjusted under 35 U.S.C. 154(b) by 0 days.

(21) Appl. No.: 11/003,803

(22) Filed: Dec. 3, 2004

(65) Prior Publication Data

US 2005/0077507 A1 Apr. 14, 2005

Related U.S. Application Data

(63) Continuation of application No. 10/325,638, filed on Dec. 20, 2002, now abandoned, which is a continuation of application No. 10/236,190, filed on Aug. 23, 2002, now abandoned.

(60) Provisional application No. 60/315,528, filed on Aug. 29, 2001.

(51) Int. Cl.
*A01K 3/00* (2006.01)
*E01F 13/00* (2006.01)

(52) U.S. Cl. ..... 256/13.1; 404/6

(58) Field of Classification Search ..... 256/13.4, 256/13.1; 404/6–9

See application file for complete search history.

(56) References Cited

U.S. PATENT DOCUMENTS 3,776,520 A * 12/1973 Charles et al. ..... 256/13.1
4,075,473 A * 2/1978 Winston ..... 256/13.1
4,260,296 A * 4/1981 Hilfiker ..... 404/7
4,466,222 A * 8/1984 Mitchell ..... 52/371
4,496,264 A * 1/1985 Casey ..... 404/6
4,655,434 A * 4/1987 Bronstad ..... 256/13.1
4,819,916 A * 4/1989 Wun-chung ..... 256/13.1
5,022,782 A * 6/1991 Gertz et al. ..... 404/6
5,039,066 A * 8/1991 Stacey ..... 256/13.1
5,078,366 A 1/1992 Sicking et al.
5,391,016 A 2/1995 Ivey et al.
5,407,298 A 4/1995 Sicking et al.
5,547,310 A * 8/1996 Muller ..... 404/6
5,765,811 A 6/1998 Alberson et al.
5,775,675 A 7/1998 Sicking et al.
5,797,591 A * 8/1998 Krage ..... 256/13.1
5,957,435 A 9/1999 Bronstad
6,022,003 A 2/2000 Sicking et al.
6,065,738 A * 5/2000 Pearce et al. ..... 256/13.1
6,109,597 A 8/2000 Sicking et al.
6,173,943 B1 * 1/2001 Welch et al. ..... 256/13.1

(Continued)

FOREIGN PATENT DOCUMENTS

WO WO 2005/028757 A1 3/2005

*Primary Examiner*—Daniel P. Stodola
*Assistant Examiner*—Victor MacArthur
(74) *Attorney, Agent, or Firm*—Paul & Paul

(57) ABSTRACT

A cable integrated guardrail system for highway guardrail. The rail of the system contains at least one cut section placed longitudinally along the panel, and of sufficient dimension as to allow interaction with a cable. Said cut sections also act to reduce longitudinal resistance and safely stop axially impacting vehicles. A cable, which is of sufficient length to extend longitudinally along the entire system, prevents tearing of the rail during lateral impacts and aids in safely redirecting the vehicle away from a hazard.

21 Claims, 8 Drawing Sheets

U.S. PATENT DOCUMENTS 6,220,575 B1 4/2001 Lindsay et al.
6,244,571 B1 6/2001 Reid et al.
6,575,434 B2 * 6/2003 Bligh et al. ..... 256/13.1
6,669,402 B1 * 12/2003 Davis et al. ..... 404/6
6,719,483 B1 * 4/2004 Welandsson ..... 404/6

* cited by examiner

INTEGRATED CABLE GUARDRAIL SYSTEM

CROSS-REFERENCE TO RELATED APPLICATIONS

This is a continuation of application Ser. No. 10/325,638 filed Dec. 20, 2002, now abandoned which in turn is a continuation of U.S. application Ser. No. 10/236,190 filed Aug. 23, 2002, now abandoned, which, in turn, is based upon provisional application 60/315,528, filed Aug. 29, 2001.

BACKGROUND OF THE INVENTION

The present invention relates to the general field of highway guardrail systems and roadside safety barriers. Principally, the invention is of an improved highway guardrail end treatment for guardrail barrier systems.

Highway safety devices utilized along most roadways are comprised primarily of guardrail barrier systems. Guardrails called W-beam guardrails are used to prevent vehicles from leaving the roadway and possibly colliding with fixed objects, other vehicles, or other safety hazards. For this, the semi-rigid guardrail barrier must be able to resist lateral impact forces, for instance a vehicle approaching at an angle to the length of rail. In this the barrier should perform in such a way that the vehicle is safely redirected back onto the roadway as opposed to tearing through or passing through the guardrail.

The ability of guardrail to resist this lateral loading force is dependent upon a universally accepted corrugated shape, which dissipates the energy of the vehicle in a safe and controlled manner. However, the rigidity of a W-beam guardrail is such that an upstream, or terminal end of a length of guardrail, can, in itself, present a hazard. Vehicles impacting the end section of a guardrail barrier without an appropriate terminal device encounter extreme forces that can lead to serious injury or death of the occupants. This problem of addressing terminal safety is a major area of research within the highway safety industry.

Recent design alternatives have placed emphasis on two main categories of terminal devices. These are terminal devices (or terminals) which gate the vehicle into a clear zone located behind the guardrail length opposite the roadway, and those that absorb the energy of the impacting vehicle through controlled dynamic buckling of the guardrail. Additionally, terminals can be either flared or tangent to the roadway.

Of the current terminal designs available, two are found to be the most widely used. Both systems are designed within the constraints of the currently accepted uniform standards, such that vehicles impacting at an angle to the length of guardrail are redirected away from the hazard. Functions during end-on impacts are design dependent to each terminal.

The first terminal system is an energy absorbing safety treatment which utilizes a customized head assembly. This head assembly functions to induce controlled buckling of the terminal guardrail, such that the vehicle is brought to a controlled stop after all impacting energy has been dissipated. The concept of this terminal system has been applied to both flared and tangent applications.

The second terminal system, existing only as a flared gating system, utilizes slotted regions in the W-beam guardrail to reduce column strength in longitudinal impacts. A designed plate is set to maintain structural integrity during impacts, such that said slotted regions do not tear and allow the vehicle to pass through the barrier.

Therefore, the intent of highway safety is to develop guardrail terminal systems which will address the issue of end-on impacts, and at the same time maintain adequate structural integrity to safely redirect vehicles during lateral impacts. Alternative designs to existing systems should provide equivalent or better safety performance, as well as increase the availability of safety hardware through lowered costs, easier installation, and wide availability of common parts.

BRIEF SUMMARY OF THE INVENTION

The aim of the present invention is such that problems with guardrail terminal sections can be addressed at the lowest possible cost to the consumer. This is attained through utilization of common parts and the reduction in hardware items required. It is also the intent that the system comply with existing design standards and is easily interchangeable in installation and components to other competitive systems.

The present invention features a cable assisted rail terminal for use in conjunction with standard highway guardrail barrier. The terminal is comprised of W-beam rail cut to allow interaction of a cable within the plane of the barrier. These cut or weakened regions are of sufficient size and quantity to properly reduce the ability of the rail to resist buckling in response to longitudinal impacts.

The invention utilizes the strength of the cable to appropriately dissipate lateral impact forces, such that the guardrail does not tear at those weakened regions, thus preventing the vehicle from leaving the roadway.

The cable, of sufficient length as to span the entirety of the terminal system, shares the load of impacting forces. The cable attachments are located such that during lateral impacts the force of the vehicle is dissipated into a ground anchor assembly, as opposed to directly through the guardrail beam.

This attachment of said cable is constructed of a common anchor bracket, known in the art, and to an anchor bracket of increased dimension from the standard item. The enlarged cable anchor bracket allows direct connection of said cable to said ground anchor assembly.

It is intended that the present invention utilize a number of support posts to maintain structural height of the guardrail panels and cable. At least one of said posts is to be frangible, while the quantity and dimension of each shall be adjusted to meet industry accepted design standards.

BRIEF DESCRIPTION OF THE SEVERAL VIEWS OF THE DRAWING

FIG. 1 A is a schematic plan view of the system of FIG. 1, mounted flared away from the path of the roadside at the angle "a".

DETAILED DESCRIPTIONS OF THE PREFERRED EMBODIMENTS

The cable integrated guardrail terminal system of the present invention utilizes a cable running the length of the system to engage an impacting vehicle in tandem with the W-beam components of said terminal. The W-beam contains holes placed longitudinally along the face of the rail to weaken column strength in axial impacts. A cable of sufficient length is used to aid in the safe redirection of laterally impacting vehicles by preventing tearing of the rail at said weakened locations. The terminal system also aids in safely bringing vehicles to a controlled stop away from the protected hazard.

The preferred embodiment of the present terminal system is as an end-treatment for highway guardrail barriers. The terminal can be used in conjunction with various other guardrail terminal anchorage systems, such as a breakaway cable anchor known in the art. The utilization of the system is to safely redirect laterally impacting vehicles back onto the roadway, and prevent vehicle spearing during end-on impacts. The system is intended to gate vehicles into a clear zone behind the guardrail barrier or bring vehicles to a controlled stop during axial impacts. The use of the terminal system is intended for all roadside applications, regardless of speed, made possible by modifying the W-beam components to fit expected impact conditions.

Figure 1:
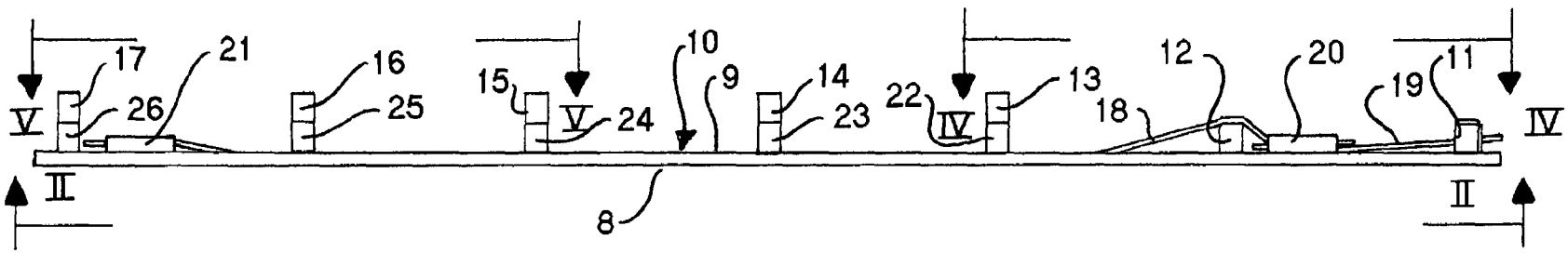
FIG. 1 is a schematic plan view of the cable integrated guardrail terminal system in accordance with the present invention.

Referring now to the system shown in FIG. 1, it will be seen that there is provided a longitudinally corrugated guardrail section generally designated by the numeral 10, mounted to a number of support posts 11, 12, 13, 14, 15, 16 and 17, with the guardrail 10 spaced from the support posts 13, 14, 15, 16 and 17 by respective spacers 22, 23, 24, 25 and 26, with the upstream end of the system illustrated at the right end of FIG. 1, and the downstream end of the system at the left end of FIG. 1, with the downstream end of the system being adapted to be attached to a normal run of guardrail barrier.

Also, as shown in FIG. 1, the system cable 18 runs the length of the system, attaching to a double anchor bracket 20 at the upstream end of the system, and to a downstream anchor bracket 21 at the downstream end of the system. The spacers 22–26 can also be referred to as post offsets. The size of the offsets can be modified to match installation criteria.

Figure 1A:
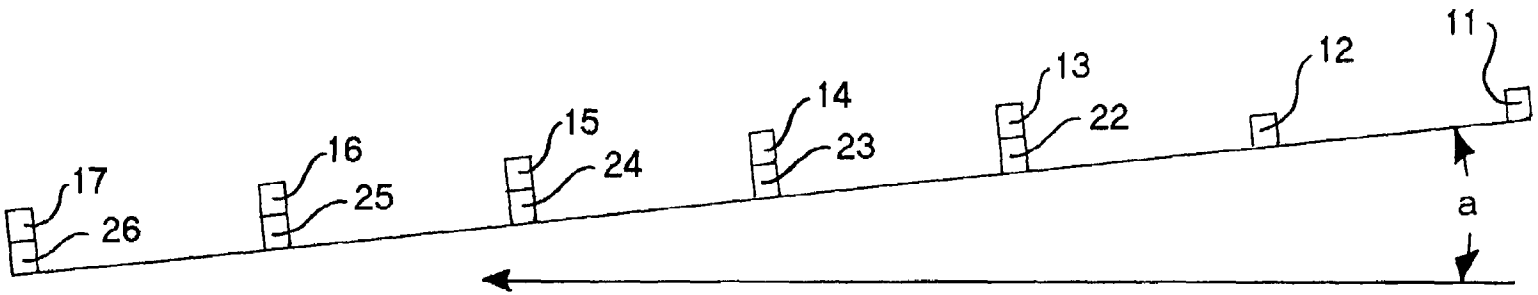

With reference now to FIG. 1A, it will be seen that the guardrail is disposed or flared at an angle "a" to the path of travel along a roadway, with the posts 11–17 positioned accordingly. The flair of the guardrail can be either straight as shown, or parabolic (not shown).

Figure 2:
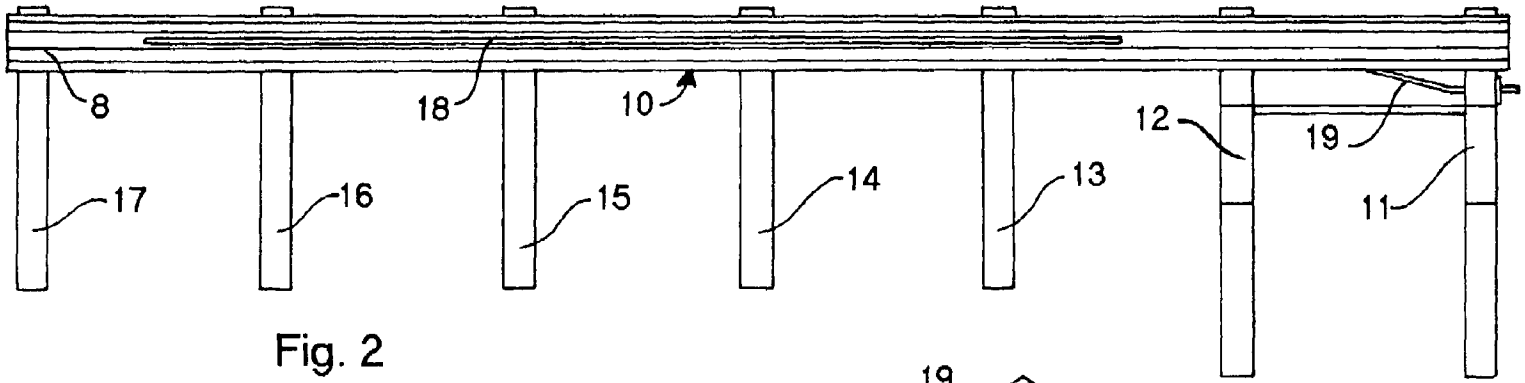
FIG. 2 is a roadside view of the terminal system of FIG. 1.
Figure 2A:
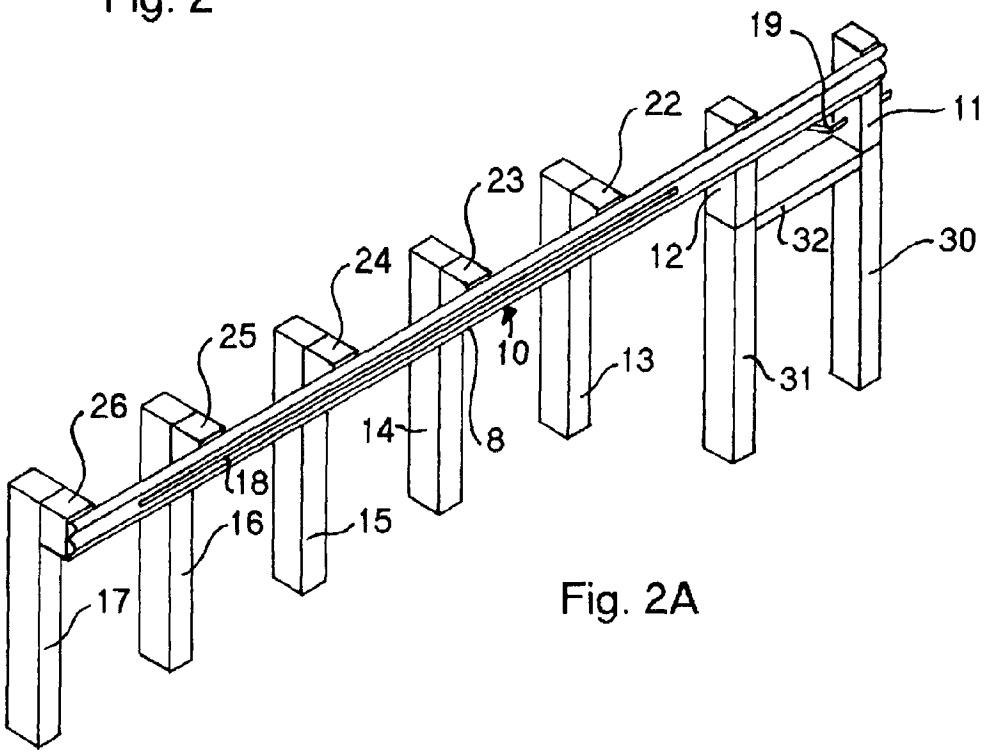
FIG. 2A is a perspective view of the terminal system of FIG. 2.
Figure 6:
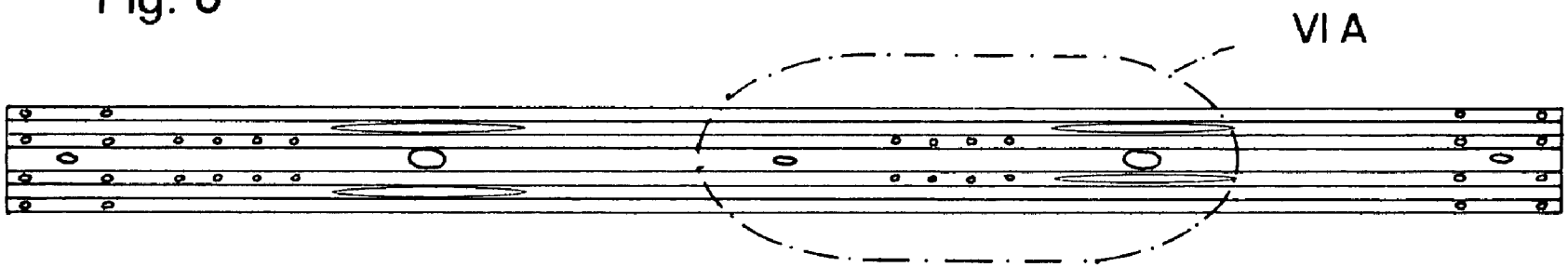
FIG. 6 is a roadside view of the W-beam rail used in the terminal system of FIG. 1.
Figure 6B:
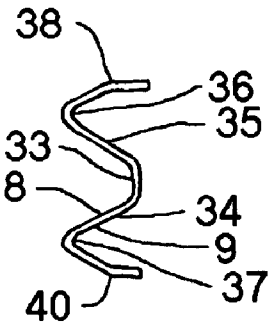
FIG. 6B illustrates the W-shaped configuration of the W-beam.
Figure 6A:
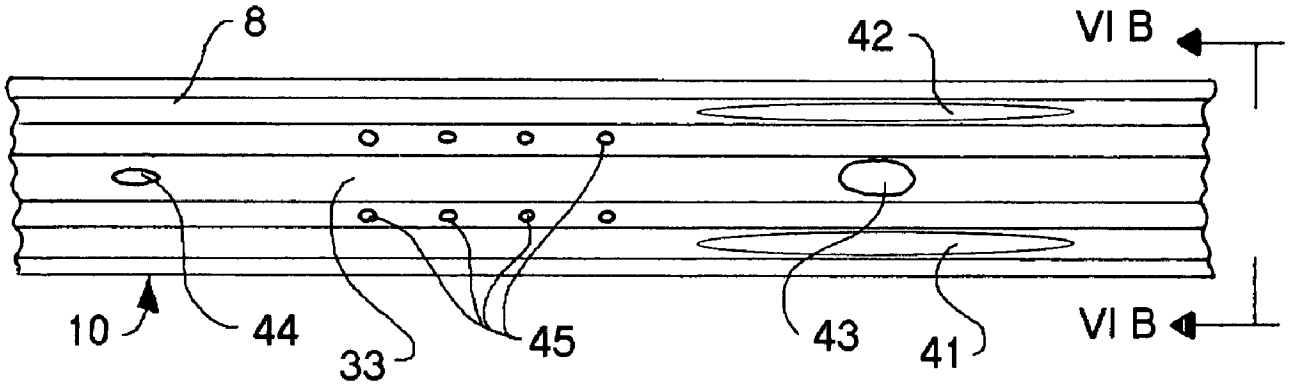
FIG. 6A is an enlarged detail view of the portion of the rail of FIG. 6 identified as VI A in FIG. 6.

With reference now to FIG. 2, it will be seen that the cable 18 is disposed on the traffic face of the guardrail 10 nested within the valley 33 thereof (as the valley 33 is shown in FIGS. 6A and 6B) of the corrugated W-beam. The cable 18 passes through holes 43 in the valley 33, as will be described hereinafter, to pass between the front side 8 and rear side 9 of the guardrail 10.

Another cable 19 passes from the double cable bracket 20, to be connected to the post 11 carried via lower soil tube 30.

The post 12 is carried via soil tube 31, with a horizontal strut member 32 disposed between soil tubes 30 and 31.

Figure 3:
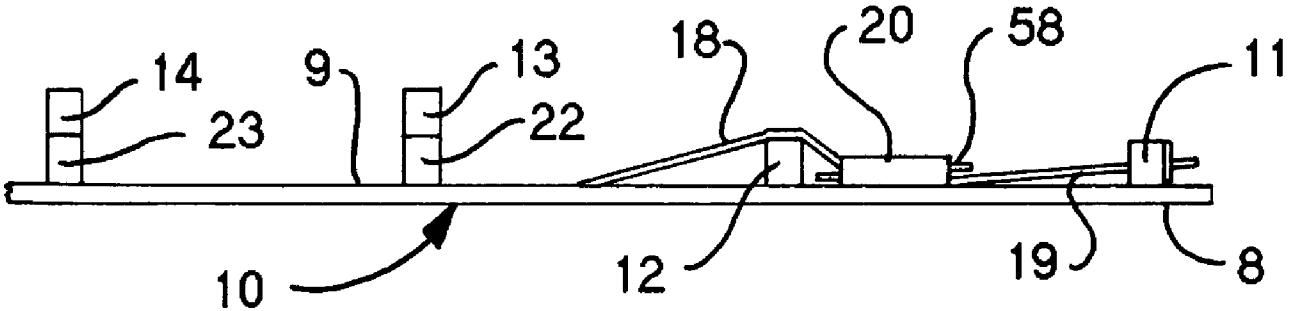
FIG. 3 is a fragmentary plan view of the double cable bracket attachment at the upstream portion of the terminal system of FIG. 1.

With reference to FIG. 3, it will be seen that the cable 18 passes through the W-beam 10 to the backside 9 thereof, with the cable 18 attaching via standard hardware to the double cable bracket 20. A standard anchor cable 19, as used in the majority of the present systems, connects the double cable anchor bracket 20 to the base of the support post 11, as shown. A square plate washer to the right of the post 11 as shown in FIG. 3, connects the double cable anchor bracket to the base of the support post 11, to distribute forces from laterally impacting vehicles into an anchor assembly that comprises the soil tubes 30 and 31 that carry the posts 11, 12, respectively.

Figure 4:
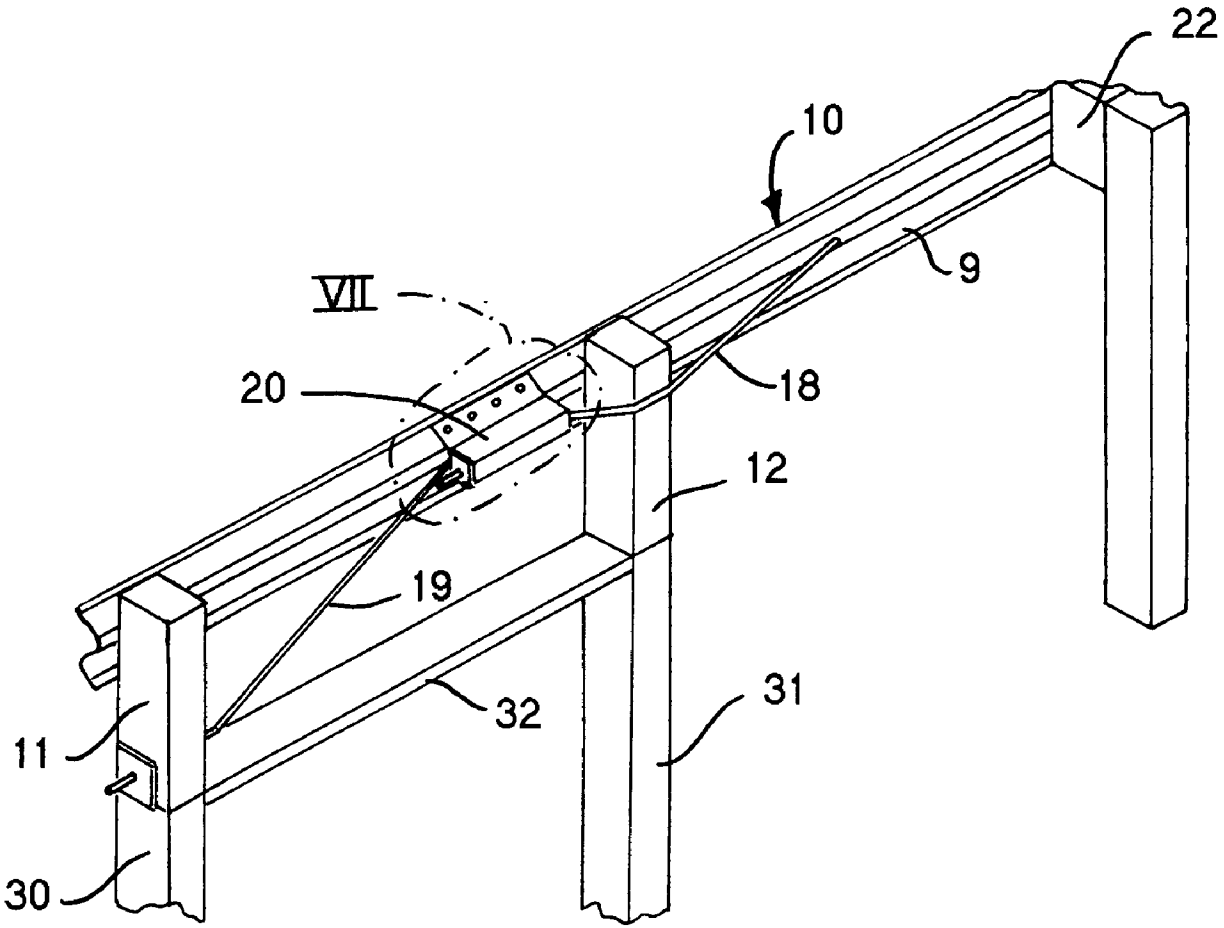
FIG. 4 is a fragmentary perspective view of the rear of the upstream end of the system of FIG. 1, illustrating the double cable bracket coupled to the system cable at the upstream portion of the terminal of FIG. 1, taken generally along the line IV—IV of FIG. 1.

With reference now to FIG. 4, it will be seen that the cable 18, after passing from the front side of the guardrail 10 to the rear side 9 thereof, around post 12, is likewise connected to the double cable anchor bracket 20.

Figure 5:
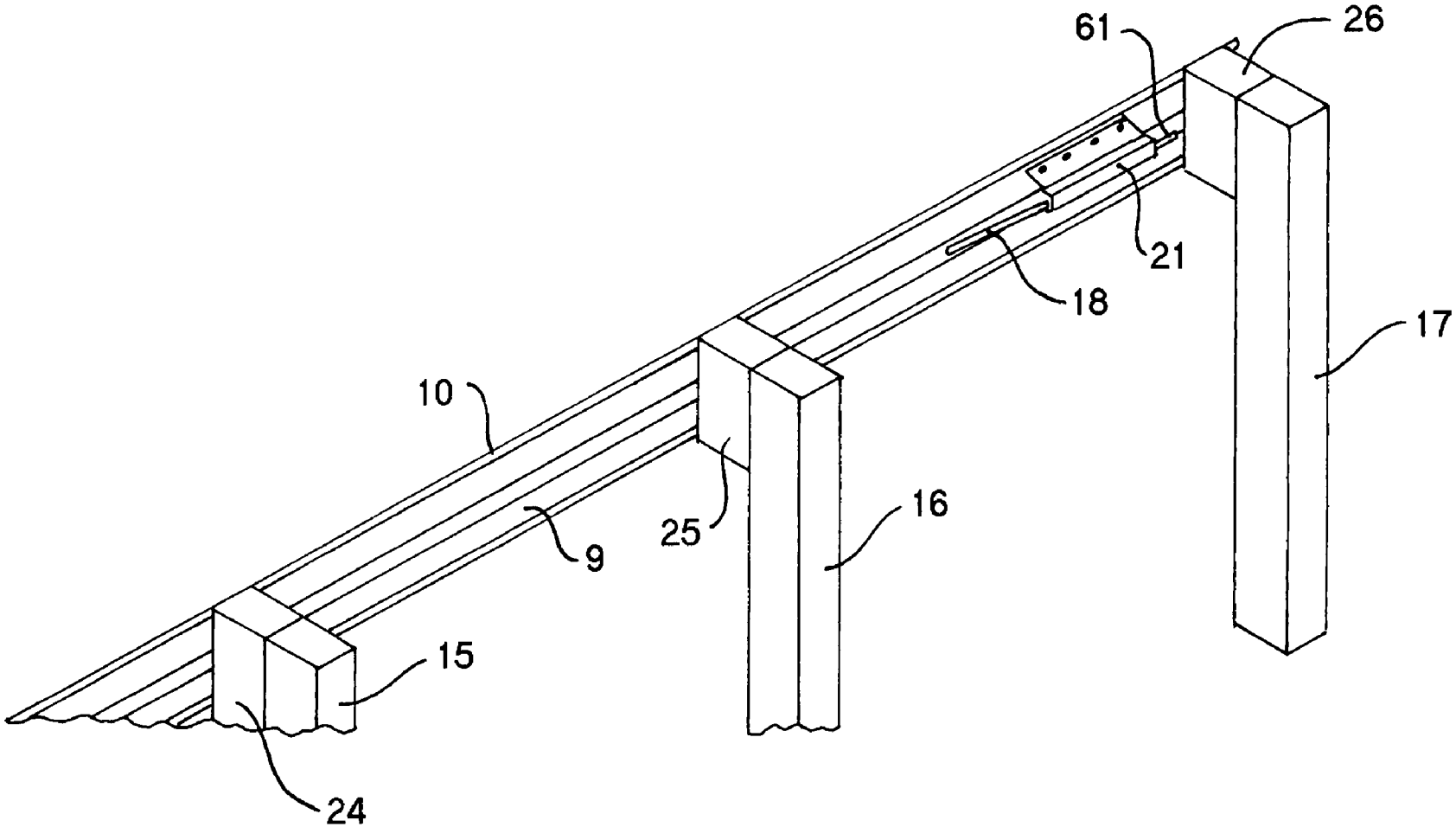
FIG. 5 is a fragmentary rear perspective view of the cable attachment to the system at the downstream portion of the terminal system of FIG. 1, taken generally along the line V—V of FIG. 1.

With reference to FIG. 5, the system cable 18 is shown, after passing from the front side 8 of the W-configured guardrail 10, to the rear side 9 thereof after traversing the length of the system, to attach to a standard single cable anchor bracket 21, mounted on the W-beam, just to the left of the post 17. The attachment of the cable 18 to the anchor bracket 21 is via standard hardware.

With reference now to FIG. 6 and to the enlarged detail 6A, it will be seen that the W-beam 10 may be constructed as shown in FIGS. 6, 6A and 6B, such that three such W-beam panels may be used to comprise the system of FIG. 1, each mounted end-to end, with each of the three W-beam panels being of substantially identical dimensions and hole placements.

The overall length of each W-beam section as shown, from left to right in FIG. 6, is 13 ft. 6 in., with three post connection holes at 6 ft. 3 in. spacing and splice connections centered at 12 ft. 6 in. spacing.

The double cable anchor bracket illustrated in FIG. 4 connects to the rail 10 behind the first of the three panels that comprise the W-beam 10 as viewed from right to left as shown in FIG. 1. The single cable anchor bracket 21 connects to the rear of the W-beam, to the third of the three W-beam sections that comprise the guardrail 10, also as shown in FIG. 1.

The cable 18, shown in FIG. 1, passes from the rear side 9 to the front side 8 of the guardrail 10, via the hole 43 as shown in FIG. 6A, which hole 43 is located at approximately the centerline of the valley 33 shown in FIG. 6A. This hole, in the current design, measures 2 in. high by 4 in. wide and is centered at approximately the middle point between post hole locations.

As shown in FIG. 6A, there are larger holes 41, 42 located at approximately each peak in the W-beam. These larger holes 41, 42, presently measure 1 in. high by 16 in. wide and are placed at the same longitudinal center as the pass-through hole 43 as shown in FIG. 6A, generally midway between the post hole locations. These holes 41, 42 are weakening zones and act to reduce column strength in the W-beam panel, forming a weakened section that affects the cross-sectional resistance to buckling in each panel of the W-beam 10, between each support post location, thereby eliminating the potential risk of vehicular spearing during axial impacts. The location, quantity and dimension of each hole 41, 42 can be altered, based upon the desired performance characteristics.

Other holes 44 are shown in FIG. 6A, as are mounting holes 45, for mounting the brackets 20, 21.

With reference to FIG. 6B, it will be seen that the W-beam 10 has a road-facing longitudinal trough or recess 33, and rearward recesses 36, 37, facing in the opposite direction, away from the road, formed between respective legs 35, 34 and respective lips 38, 40, which lips, 38, 40 face away from the road, such that the configuration illustrated in FIG. 6B forms the W-shaped configuration discussed above.

Figure 7:
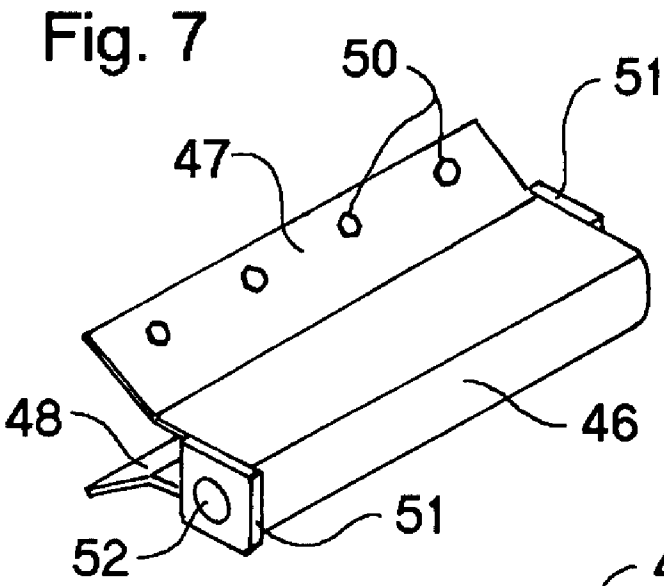
FIG. 7 is a perspective view of the double cable bracket of FIG. 4, taken of the detail VII of FIG. 4.

The double-cable bracket illustrated in FIG. 7 is used in the present invention to attach the system cable 18 to the W-beam component 10 and to attach the standard anchor cable 19, as discussed above.

Figure 7A:
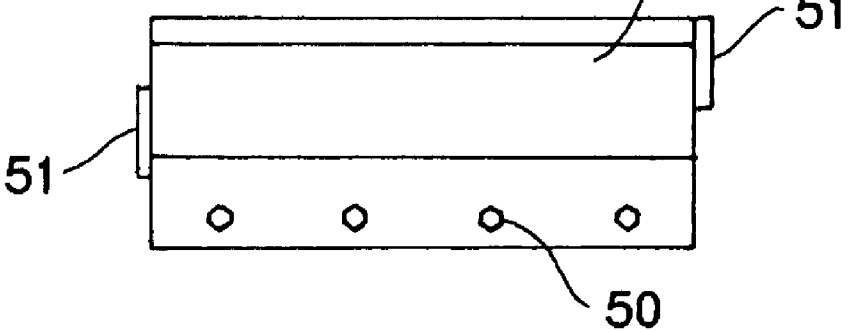
FIG. 7A is a bottom view of the bracket of FIG. 7.
Figure 8:
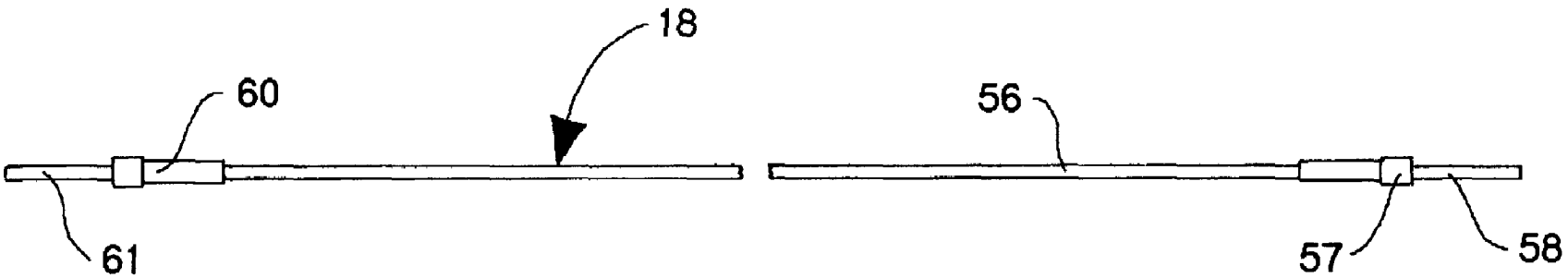
FIG. 8 is a fragmentary view of the cable assembly as used in the terminal system of FIG. 1.

The double cable bracket 20 of FIG. 1, is illustrated in perspective view in FIG. 7, and comprises a U-shaped component 46 terminating in upper and lower angled legs 47, 48, with bolt holes 50 for attachment to the W-beam, and has an end plate square washer bracket 51, with an opening 52 therethrough for receipt of a cable end of the cable 56 of FIG. 8 therethrough. It will be seen that end plates 51 are provided at each end of the bracket 46 as shown in FIG. 7A, for connection therethrough of the cables 18, 19, with one connected at each end plate 51 (not shown).

With reference to the cable of FIG. 8, it will be seen that the same can be connected through the openings 52 in the plates 51, by means of standard nut and washer hardware, as can the brackets 20 and 21 be connected to the W-beam via standard hardware, through connection holes 50 in the brackets and through holes 45 in the W-beam 10. The brackets 20, 21 can be modified in dimension and quantity to allow connections with additional cables, depending upon the requirements of the system.

Figure 7B:
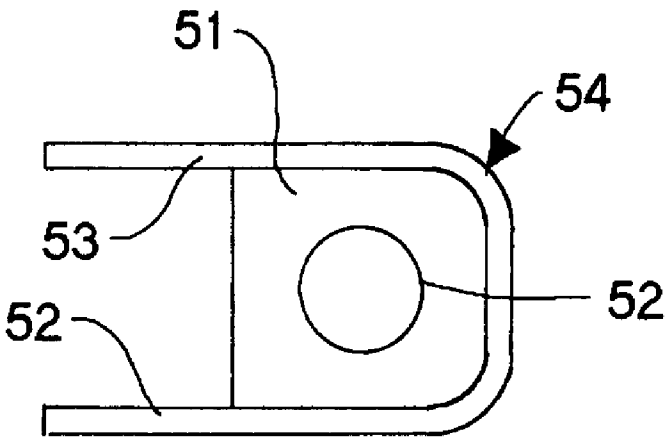
FIG. 7B is an end view of a brace that slips over the cable bracket of FIGS. 7 and 7A and is welded thereto.

With reference to FIG. 7B, it will be seen that a leftwardly opening U-shaped outside brace 54, having leftwardly extending legs 52 and 53 is shown, which can be slipped over the standard anchor box 46 of FIGS. 7 and 7A, and welded thereto.

With reference to FIG. 8, it will be seen that the cable 18 is shown, as having one end for connection through the anchor box 20, and the other end for connection to the anchor box 21, with the ends of the cables being shown at 58 and 61, such that cable sections 56 thereof are connected to the anchor boxes via swaged fittings 57 and 60. The cable 18 may be of ¾ in. thickness, and of such length as required, which length can be modified to extend over the distance required in any modification of the present system.

What is claimed is:

1. A highway guardrail system for use along a roadside and having upstream and downstream ends, comprising:

(a) at least one longitudinally corrugated rail adapted to be generally horizontally mounted along a roadway by a plurality of support posts and having a generally longitudinal valley therein, said at least one rail having a front side and a rear side;

(b) two openings in the at least one rail provided at longitudinally spaced-apart upstream and downstream locations along the at least one rail, each of said two openings extending through the rail from said front side to said rear side;

(c) a longitudinal cable substantially spanning the distance between said two openings in the at least one rail, each of said two openings being of sufficient dimension to allow passage of said longitudinal cable therethrough, said longitudinal cable extending through each of said two longitudinally spaced-apart openings and thereby passing from said front side of said at least one rail to said rear side of said at least one rail at said longitudinally spaced-apart upstream and downstream locations along said at least one rail; and (d) an anchor bracket anchoring said longitudinal cable to said at least one rail.

2. The system of claim 1, wherein the guardrail system includes support posts mounted along the roadway, with the at least one rail being generally horizontally mounted to and carried by said support posts, with the valley of said at least one rail being on said front side of the at least one rail and facing the roadway with said longitudinal cable being substantially disposed therein; with the at least one rail having said rear side facing away from the roadway; with said anchor bracket being mounted at the rear side of the at least one rail.

3. The system of claim 2, wherein there are two anchor brackets mounted on the rear side of the at least one rail, at longitudinally spaced-apart upstream and downstream locations, for anchoring the longitudinal cable to the rear side of the at least one rail at said longitudinally spaced-apart upstream and downstream locations of said anchor brackets.

4. The system of claim 2, wherein the at least one rail is flared away from the roadway at an upstream end of the at least one rail.

5. The system of claim 2, including at least one weakened zone in the at least one rail, with said zone being of sufficient dimension to reduce the strength of the rail in resisting collision, in the event of collision of a vehicle therewith.

6. The system of claim 1, wherein the at least one rail is of generally W-shaped transverse cross-section, having two peaks and one valley facing the roadway.

7. The system of claim 1, wherein the at least one rail comprises a plurality of rail panels.

8. A highway guardrail system for use along a roadside and having upstream and downstream ends, comprising:

(a) at least one longitudinally corrugated rail adapted to be generally horizontally mounted along a roadway by a plurality of support posts, said at least one rail having a front side including a first longitudinal valley disposed between first and second longitudinal peaks and a rear side including a third peak disposed between second and third longitudinal valleys, said at least one rail comprising a plurality of rail panels;

(b) two openings in said at least one rail provided at longitudinally spaced-apart upstream and downstream locations along said at least one rail, each of said two openings extending through the rail from the first valley to the third peak;

(c) a longitudinal cable substantially spanning the distance between said two openings and disposed longitudinally in said first rail valley, said longitudinal cable extending through each of said two longitudinally spaced-apart openings and thereby passing from said front side of said at least one rail to said rear side of said at least one rail at said longitudinally spaced-apart upstream and downstream locations along said at least one rail; and (d) a cable anchor bracket anchoring said longitudinal cable to said rear side of said rail.

9. The system of claim 8, wherein the guardrail system includes support posts mounted along the roadway, with the at least one rail being generally horizontally mounted to and carried by said support posts, with said front side of the at least one rail facing the roadway and said rear side facing away from the roadway.

10. The system of claim 9, wherein at least one said support post is frangible.

11. The system of claim 8, wherein there are two anchor brackets mounted on the rear side of the at least one rail, at longitudinally spaced-apart upstream and downstream locations, for anchoring said longitudinal cable to the rear side of the at least one rail at said longitudinally spaced-apart upstream and downstream locations of said anchor brackets.

12. The system of claim 11, wherein the at least one rail is flared away from the roadway at an upstream end of the at least one rail.

13. The system of claim 11, including a ground anchor assembly proximate the upstream end of said at least one rail, with said ground anchor assembly being connected to the upstream anchor bracket via a ground anchor cable.

14. The system of claim 13, wherein the upstream anchor bracket has connections for connecting the longitudinal cable thereto and for connecting the ground anchor cable thereto.

15. The system of claim 14, wherein the downstream anchor bracket has a connection for connecting the longitudinal cable thereto.

16. The system of claim 8, including at least one weakened zone in the at least one rail, with said zone being of sufficient dimension to reduce the strength of the rail in resisting collision, in the event of collision of a vehicle therewith.

17. The system of claim 8, including at least one weakened zone in the at least one rail, with said zone being of sufficient dimension to reduce the strength of the rail in resisting collision, in the event of collision of a vehicle therewith, wherein said weakened zone is comprised of holes through the at least one rail, located through each of said first and second peaks and said first valley of said at least one rail.

18. The system of claim 17, wherein there are a plurality of longitudinally spaced-apart said weakened zones along said at least one rail, each comprised of holes through said at least one rail.

19. A highway guardrail system for use along a roadside and having upstream and downstream ends, comprising:

(a) a plurality of support posts;

(b) at least one longitudinally corrugated rail adapted to be generally horizontally mounted along a roadway by said plurality of support posts, said at least one rail having a front side including a first longitudinal valley disposed between first and second longitudinal peaks and a rear side including a third peak disposed between second and third longitudinal valleys;

(c) at least one opening in the at least one rail, said at least one opening extending through the rail from the first valley to the third peak;

(d) a longitudinal cable substantially disposed longitudinally in said first rail valley, said longitudinal cable passing through said at least one opening from said front side of said at least one rail to said rear side of said at least one rail; and (e) a cable anchor bracket anchoring said longitudinal cable to said rear side of said rail.

20. The system of claim 19, wherein at least one of said plurality of support posts is disposed between said rail and said longitudinal cable.

21. The system of claim 19, wherein the at least one rail comprises a plurality of rail panels.

* * * * *